United States Patent [19]

Pocrass

[11] Patent Number: 4,978,317

[45] Date of Patent: Dec. 18, 1990

[54] CONNECTOR WITH VISUAL INDICATOR

[76] Inventor: Alan Pocrass, 15161 Magnolia Blvd., Condo E, Sherman Oaks, Calif. 91403

[21] Appl. No.: 328,624

[22] Filed: Mar. 27, 1989

[51] Int. Cl.[5] ..... H01R 13/00

[52] U.S. Cl. ..... 439/490

[58] Field of Search ..... 439/489, 490, 571, 572, 439/573, 676, 357, 358

[56] References Cited

U.S. PATENT DOCUMENTS 4,379,606 4/1983 Clark et al. ..... 439/490 X 4,457,570 7/1984 Bogese, II ..... 439/347 X

*Primary Examiner*—Z. R. Bilinsky

*Attorney, Agent, or Firm*—Webb, Burden, Ziesenheim & Webb

[57] ABSTRACT

A connector for receiving a plug to form an electrical connection comprising a housing having a front wall, a rear wall, a top wall, and a bottom wall, said front wall having a plug receiving opening therein, and a visual indicator positioned within said front wall above said plug receiving opening such that said visual indicator provides visual verification of the status of the electrical connection.

9 Claims, 2 Drawing Sheets

CONNECTOR WITH VISUAL INDICATOR

BACKGROUND OF THE INVENTION

1. Field of the Invention

This invention relates to connectors having a visual indicator. More particularly, this invention relates to a modular receptacle jack having an integral light-emitting diode to provide a visual verification of a connection formed by the modular receptacle jack.

2. Description of the Prior Art

A modular receptacle jack, also known as an RJ connector, is commonly used in telecommunications and data networking equipment. An RJ connector typically forms a link between two pieces of equipment to provide a means of communication between the equipment. In order to ensure the integrity of the link, it has been a practice in the industry to use a light-emitting diode, also known as an LED located separate from the link to provide visual status and fault information regarding the connection. An LED located separate from the RJ connector link inherently results in inefficient use of production labor to install the separate devices and an increase in space required by the separate devices in the circuit.

With a view to the aforementioned, I have invented an RJ connector with at least one LED integrated into the module to form a single unit. The RJ connector LED combination solves the space limitations imposed on manufacturers of electronic equipment, including communications equipment, who are utilizing modular connectors for connectivity in data networking equipment as well as in voice equipment. The RJ connector LED module produced in accordance with the present invention allows for maximum capacity on networking products, which leads to high component and connector densities on printed circuit boards and modules. Moreover, the use of LED's in an RJ connector presents a cost saving to manufacturers who previously used LEDs and RJ connectors separately in their products. The cost saving occurs due to lower labor costs needed to attach one RJ connector LED to the equipment versus attaching the LED and connector separately.

Accordingly, it is an object of the present invention to provide an RJ connector including an LED formed integral therewith. It is another object of the present invention to provide an RJ connector of a type commonly used in telecommunications and data networking equipment with an integral LED device to emit a light when the connector is receiving or transmitting voice or data signals. Another object of the present invention is to provide an RJ connector with an integral LED device to emit a light to indicate an operation function such as the reception or transmission of data or voice signals, verification of a link between separate pieces of equipment, indication when power is on, indication of a condition in the access method such as when a collision in ethernet transmission has occurred, or any other state of condition in the equipment at both ends of the link.

SUMMARY OF THE INVENTION

Briefly, according to this invention, there is provided a connector for receiving a plug to form an electrical connection comprising a housing having a front wall, a rear wall, a top wall, and a bottom wall. The front wall has a plug receiving opening therein, and a visual indicator positioned within the front wall adjacent the plug receiving opening. The visual indicator provides visual verification of the status of the electrical connection.

More particularly, the present invention includes a modular receptacle jack connector having a front wall, a rear wall, a top wall, and a bottom wall. The front wall has a plug receiving opening therein, and a light-emitting diode positioned within the front wall such that the light emitting diode provides visual verification of the status of the electrical connection.

BRIEF DESCRIPTION OF THE DRAWINGS

Further features and other objects and advantages of this invention will become clear from the following detailed description made with reference to the drawings in which.

DESCRIPTION OF THE PREFERRED EMBODIMENTS

Figure 1:
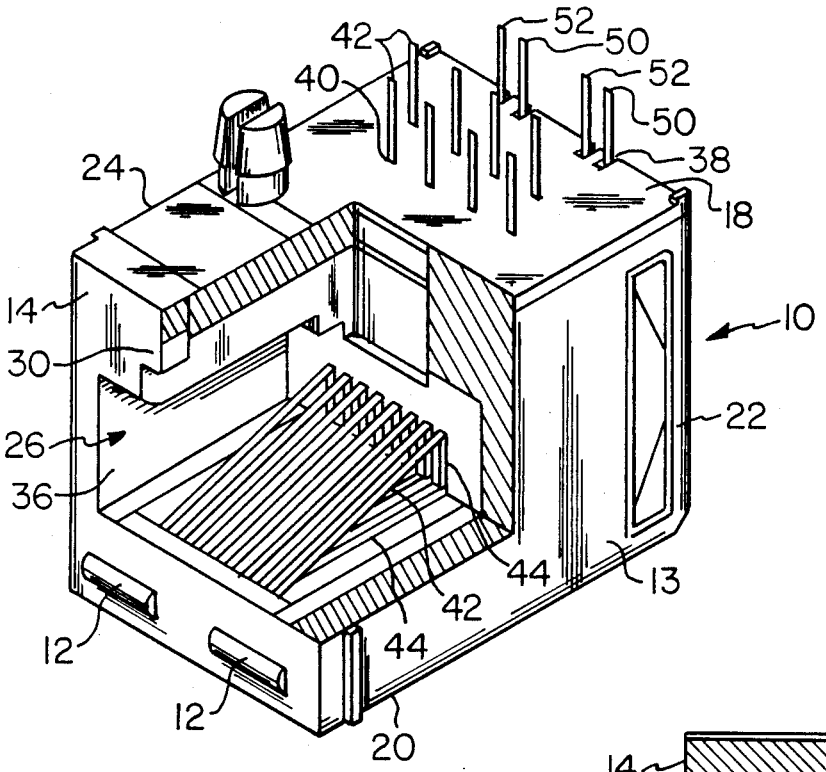
FIG. 1 is a perspective view, partially cut-away, of the electrical connector of the present invention.

Referring to the drawings, wherein like reference characters represent like elements, FIGS. 1–8 illustrate a connector 10 for receiving a plug (not shown) to form an electrical connection. The connector 10 includes a visual indicator 12 integrated within the connector to provide visual verification of the status of the electrical connection.

The connector 10 may be a modular receptacle jack, also known as an RJ connector. The RJ connector includes a one-piece molded plastic housing 13 having a front wall 14, a rear wall 16, a top wall 18, a bottom wall 20 and side walls 22 and 24. It should be understood that the designation of wall as a "top" wall is made with respect to the view of the housing illustrated in FIG. 1, but that, in use, top wall may, in fact, be oriented as a bottom wall. The designations "top" and "bottom" are therefore made for ease of explanation of the invention, and should not be interpreted as limiting in any way.

An opening 26 is formed in the front wall 14. Opening 26 is adapted to receive a miniature modular mating plug (not shown). The modular mating plug of a conventional design generally includes a dielectric housing having a free end for insertion into the opening 26 of the housing 13, a cord input end having a cavity for receiving a multi-conductor cord, and a resilient locking tab integrally connected by a flexible hinge to the free end of the dielectric housing and extending obliquely rearwardly therefrom. The modular mating plug also includes a terminal receiving side having partitions which define side-by-side slots in communication with the cavity. Substantially flat, electrically conductive contact terminals are positioned within the slots and extend into the cavity, and the terminals include insulation-piercing tangs for making electrical engagement with associated conductors of the cord and upper edge portions for making electrical contact external to the plug.

Figure 2:
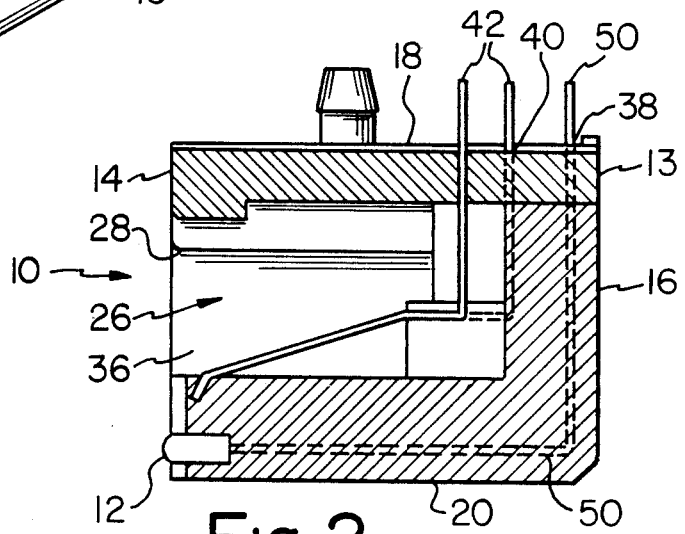
FIG. 2 is a side sectional view of the electrical connector.
Figure 3:
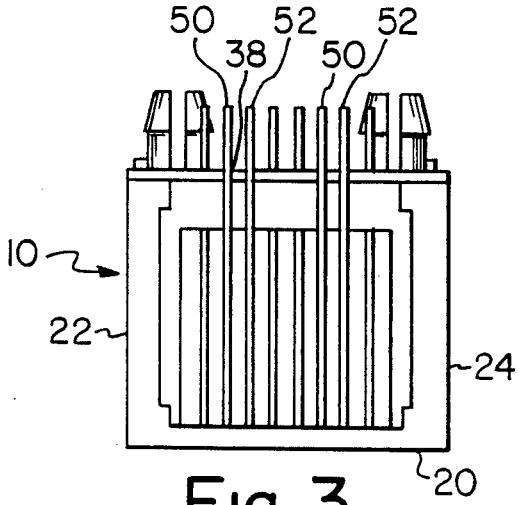
FIG. 3 is a rear view of the electrical connector of FIG. 1.
Figure 4:
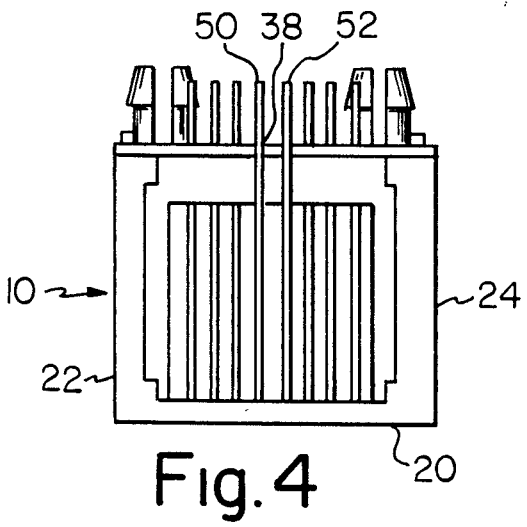
FIG. 4 is a rear view of the electrical connector having one LED indicator.
Figure 5:
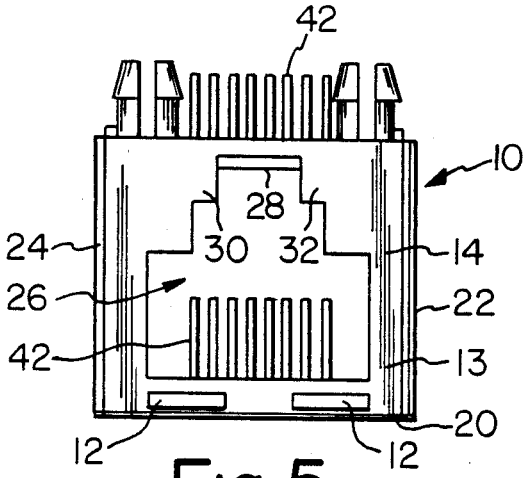
FIG. 5 is a front view of the electrical connector having two rectangular LED indicators.
Figure 6:
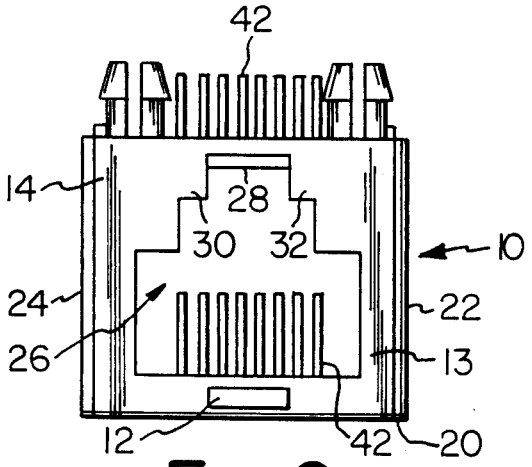
FIG. 6 is a front view of the electrical connector having one rectangular LED indicator.
Figure 7:
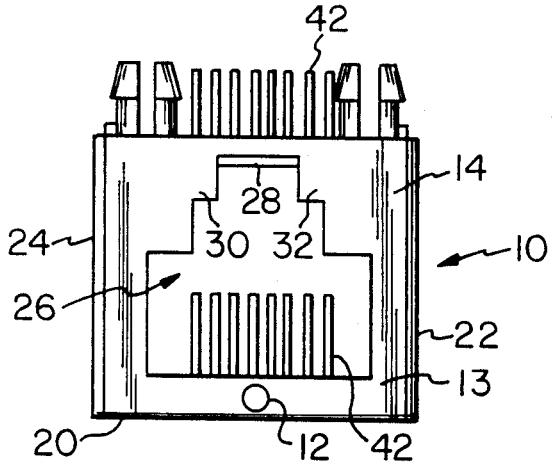
FIG. 7 is a front view of the electrical connector having one circular LED indicator.
Figure 8:
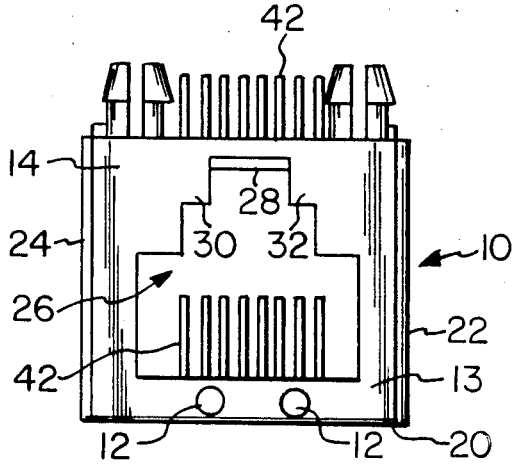
FIG. 8 is a front view of the electrical connector having two circular LED indicators.

Referring to FIGS. 1 and 2, opening 26 is defined by opposing internal end walls which include inner surface of bottom wall 20 and inner surface of top wall 18, and opposing inner surfaces of side walls 22 and 24.

Top wall 18 includes a forwardly disposed inclined ramp 28 which extends to spaced apart shoulders 30 and 32 which cooperatively maintain plug in place within opening 26. A substantially rectangular, elongated recess 36 or keyway may extend from front wall 14 rearwardly in side walls 22 and 24 for receiving a mating key formed on the side of certain mating plugs.

Opening 26 is further defined by a rear wall 16 which extends transversely across the rear portion of the housing 10. Outer rear wall surface has formed therein a plurality of alternating inwardly extending slots 38 which longitudinally extend within the rear wall 16 and top wall 18, FIGS. 3 and 4. Slots 38 contain therein electrical lead wires 50 and 52 to be more fully described herein.

A plurality of apertures 40 or holes are formed in top wall 18. The apertures 40 are formed in alternating positions in top wall 18 and extend through top wall, parallel to both rear wall 16 and slots 38 and terminate at inner rear wall 16 within opening 26. Apertures 40 are adapted to receive portions of conductor wires 42. As shown, in FIGS. 1 and 2 conductors 42 extend through housing 10 in a side-by-side, spaced apart fashion, and may be round, rectangular, or stamped metallic parts. Conductors 42, however, are preferably round conductor wires which are coated with a precious metal, such as gold, to increase their conductivity, longevity and reliability.

The ends of conductor wires 42 which terminate at inner rear wall 16 open onto conductor receiving means which preferably takes the form of a plurality of parallel side-by-side slots 44 formed in rear wall 16 and bottom wall 20. Slots 44 preferably extend from inner rear wall 16 downwardly and forwardly along inner bottom wall 20 and are deep enough to accommodate the spring contact portions as they move under spring contact pressure applied by terminals in mating plug (not shown).

Conductor wires 42 extend perpendicularly from bottom wall 20 through top wall 18 in an alternating, staggered fashion so as to be readily insertable within correspondingly spaced holes in a printed circuit (PC) board. The spacing between adjacent conductor wires 42 measured laterally may be, for example, 0.050 inch to correspond with standard pad spacing on the printed circuit (PC) board. The adjacent alternating slots 38 and apertures 40 are therefore formed with the same center-to-center spacing as would be required for the corresponding spaced holes in a particular printed circuit board. The inner ends of slots 38 are preferably sized slightly smaller than the diameter of electrical lead wires 50 and 52 to secure the wires in place after the wires are forced within the slots 38.

The RJ connector described herein and shown in FIGS. 1–8 includes a visual indicator 12. In a preferred embodiment, the visual indicator may be a light-emitting diode (LED) indicator of a conventional design, and may be either rectangularly shaped or round shaped or of any other suitable geometric shape. LED indicators of various colors, such as green, red, amber and yellow for example, can be used to display various conditions in a given circuit. The LED indicator is positioned in an opening within front outer wall 14. The LED indicator comprises a light-emitting portion 12 having electrical lead wires 50 and 52. The LED device may be molded simultaneously with the housing 13 of the modular style connector or an opening may be molded in the modular style connector and then the LED indicator placed therein and adhesively cemented in place, if needed. Whichever method of manufacture is used, the LED indicator anode(s) lead wires 50 and cathode(s) lead wires 52 extend through or along the bottom wall 20 spaced from the connector wires or pins 42 and exit through rear wall 16, and extend above top wall 18 aligned in slots 38, FIGS. 1, 3 and 4. The connector 10 with upwardly extending contact pins 42 and LED lead pins 50 and 52 are then plugged into a printed circuit board which is prewired to accept this unique pin array. A visible wavelength of energy may be observed through the indicator which is visible from front wall 14 to thereby signal the status of the connection formed by the plug and RJ connector module.

It will be appreciated that an RJ connector is available in a variety of sizes, and internal configurations and may be molded in a number of ways commonly known in the art and is not a limitation to the present invention. The only requirement being that the RJ connector has a visible surface accessible for the placement of at least one LED indicator. However, the most common RJ connectors for which the present invention would be most useful are known in the industry by persons skilled int he art as the RJ11 and RJ45. The RJ11 is the four or six pin connector and is often used in the telephone industry. The RJ45 is an eight pin connector used for a multitude of telecommunications and data communication devices.

An example of the use of an RJ connector with integrated LED indicator manufactured in accordance with the present invention by the telephone industry would be to indicate that a phone is in use. An RJ connector with integrated LED indicator may also indicate if someone is using a phone from another room. Similarly, in data communications, the LED may be used to indicate if data is being transmitted or received. Additional status conditions are possible depending upon the application and PC board circuitry. For example, the LED indicator may indicate whether or not a communication link between data processing systems has been established.

Having described presently preferred embodiments, it is to be understood that it may be otherwise embodied within the scope of the appended claims.

I claim:

1. An RJ type modular connector for receiving a plug to form an electrical connection in data communication or telecommunication applications comprising:

a housing formed by front, rear, top and bottom walls and having a plug receiving opening formed within the front wall thereof;

at least one light emitting source integrally secured within said housing adjacent the plug receiving opening thereof to provide visual verification of the status of the electrical connection;

a plurality of conductor wires, including conductor wires from said light emitting source, extending through one of said housing walls arranged in a predetermined spaced-apart array, adapted for insertion within a corresponding array of spaced holes in a printed circuit board.

2. The connector as set forth in claim 1 wherein said visual indicator is a light emitting diode.

3. The connector as set forth in claim 2 wherein said light source is two or more light emitting diodes.

4. The connector as set forth in claim 2 wherein said light emitting diode is rectangular shaped.

5. The connector as set forth in claim 2 wherein said light emitting diode is circular shaped.

6. The connector as set forth in claim 1, wherein said visual indicator includes electrical lead wires extending through said top wall within a slot parallel to said conductor wires and spaced in a predetermined array adapted to be insertable within corresponding spaced holes in a printed circuit board.

7. The connector as set forth in claim 6, wherein said modular receptacle jack is a four pin RJ connector of the type known in the telephone industry as RJ11.

8. The connector as set forth in claim 6, wherein said modular receptacle jack is a four pin RJ connector of the type known in the telephone industry as RJ11.

9. The connector as set forth in claim 6, wherein said modular receptacle jack is an eight pin RJ connector of the type known in telecommunications industry as RJ45.

* * * * *

UNITED STATES PATENT AND TRADEMARK OFFICE

CERTIFICATE OF CORRECTION

PATENT NO. : 4,978,317

DATED : December 18, 1990

INVENTOR(S) : Alan Pocrass

It is certified that error appears in the above-identified patent and that said Letters Patent is hereby corrected as shown below:

Column 4 Line 33 "int he" should read --in the--.

Claim 8 Line 7 Column 6 "four" should read --six--.

Signed and Sealed this

Ninth Day of June, 1992

*Attest:*

DOUGLAS B. COMER

*Attesting Officer*

*Acting Commissioner of Patents and Trademarks*